US005454197A

United States Patent [19]

Horrigan

[11] Patent Number: 5,454,197

[45] Date of Patent: Oct. 3, 1995

[54] APPARATUS FOR MOUNTING A TUBULAR SAFETY STANCHION-VENT ELEMENT THROUGH A ROOF

[76] Inventor: Francis J. Horrigan, 5093 Fleming Rd., Mt. Airy, Md. 21771

[21] Appl. No.: 936,235

[22] Filed: Aug. 21, 1992

[51] Int. Cl.[6] ..... E04H 12/28; A62B 35/00

[52] U.S. Cl. ..... 52/199; 52/198; 52/218; 52/219; 182/9; 248/237

[58] Field of Search ..... 52/218, 219, 199, 52/198; 248/57, 58, 237, 499, 507; 285/43, 42, 194, 192; 182/9

[56] References Cited

U.S. PATENT DOCUMENTS 843,375 2/1907 Thompson ..... 248/57

2,648,511 8/1953 Epstein ..... 248/57

5,011,106 4/1991 Cody ..... 248/237

5,054,576 10/1991 Glynn ..... 248/237

*Primary Examiner*—Carl D. Friedman

*Assistant Examiner*—Christopher Todd Kent

[57] ABSTRACT

There is disclosed an apparatus, for mounting a combined roof plumbing vent, and a safety stanchion element, on a roof with its roof covering, the elements having a mounting bracket, in conjunction with the roof beam element, being formed by fixedly connecting with a least one roof beam or rafter element, a substantially vertical tubular element, and having a fixably attached in a known manner, a roof covering.

1 Claim, 1 Drawing Sheet

APPARATUS FOR MOUNTING A TUBULAR SAFETY STANCHION-VENT ELEMENT THROUGH A ROOF

FIELD OF THE INVENTION

This invention relates to an apparatus for mounting safety elements on a roof, and more particularly an apparatus for mounting stanchion(as attaching point for safety lines)-plumbing vent (for vent purposes), type elements on a roof.

BACKGROUND OF THE INVENTION

There is disclosed in U.S. Pat. No. 4,426,813 to Buzzi, Jr., a system for mounting elements on a roof comprising mounting brackets having plurality of bores or openings mounted to the roof beams by compression brackets and supporting mounting members for holding roof elements above the roof elements on the roofing surface. In this item there is no disclosure of a combination of the two synergistically co-acting elements of a plumbing vent and a tubular stanchion, for safety of roof worker, tie off.

There is disclosed in U.S. Pat. No. 4,269,173 to Keueger et al. a system for mounting solar collector panels comprising modular sections having leg members mounted to the top of the roof by angle mounted brackets and supporting mounting spars for holding solar panels. Therefore, the weight of the solar collecting system is essentially on the roofing surface. This item discloses no stanchion abilities.

A second type of mounting system for solar collectors on a roof is disclosed in U.S. Pat. No. 4,204,523 to Rothe wherein a flat rectangular shell surrounded by an outer frame is mounted on the roof sheeting. The shell is supported directly on the roof after the roof tiles have been removed. This mounting assembly is in close proximity to the roof. See immediately above.

U.S. Pat. No. 4,,226,058 discloses an anchor bolt for securing a bracket to a roof supported by a beam including a shank threaded upper end and a "J" shaped lower end. This device does not disclose any permanent stanchion object fixedly attached through the roof.

In each of the described embodiments, a major problem arises; that is, any stanchion elements so mounted directly upon the roof or on the roof covering itself involves a separate penetration of the roof system. Additionally, the methods of mounting previously described, cause the mounted stanchion-vent or other elements to be disposed in an ineffective relationship with the roofing material thereby causing the occurrence of wood rot, slate failure and the like from water seepage. Additionally, by stanchion-vent or other elements mounted directly on a roofing material there will be compression of the roofing material with the roof surface leading to physical damage of the roofing material.

OBJECTS OF THE INVENTION

An object of the present invention is to provide a novel apparatus for mounting stanchion-plumbing vent elements on a roof to provide a life line, safety belt, and lanyard, workman safeguard security stanchion or tie-off, in order to keep the workmen from falling off of the roof.

Another object of the present invention is to provide a novel apparatus for mounting elements on a slate, cedar shake, shingled or similar roof.

Another object of the present invention is to provide a novel apparatus for a closeable duct stanchion mounted element on a slate, cedar shake, shingled or similar roof.

Still another object of the present invention is to provide a novel apparatus for mounting elements or tying off a worker on a roof wherein the weight of these elements are transferred from the roof stanchion onto the underlying roof beams.

A further object of the present invention is to provide a novel apparatus for mounting elements on a roof which maintains the water tight integrity of the roofing surface.

SUMMARY OF THE INVENTION

These and other objects of the present invention are achieved by an apparatus for mounting vents and stanchion tie off elements on a roof, the elements having a mounting bracket, and the roof being formed by a plurality of beam supports wherein are mounted a plurality of spaced transverse roof braces or supports having a fixably attached roof covering thereon, the roof covering having a plurality of partially penetrating bores to be selectively opened there through, said apparatus comprising a sleeve member positioned on said roof covering and formed by a "U" shaped plate member having at least one opening there through; for fixed connection and a tubular stanchion-vent collared roof covering member affixed to the plate member or members in substantial vertical axial alignment with the roof member thereby forming a duct. The duct is positioned in axial alignment with the bore in the roof covering. The mounting apparatus also comprises a mounting member positioned on the beam supports, having an attachment member in axial alignment with the bore in the roof covering and the duct formed in the sleeve member and engaged to the attachment member of the mounting member and extending upwardly through the bore in the roof covering and the duct formed in the sleeve member which stanchion plumbing-vent member is fixably engage able with the mounting bracket of the element to be mounted on the roof.

Other objects and advantages of the present invention will become apparent by reference to the following detailed description of the embodiment thereof when taken in conjunction with the accompanying drawings, in which the subject device is disclosed.:

DETAILED DESCRIPTION OF THE INVENTION

Figure 2:
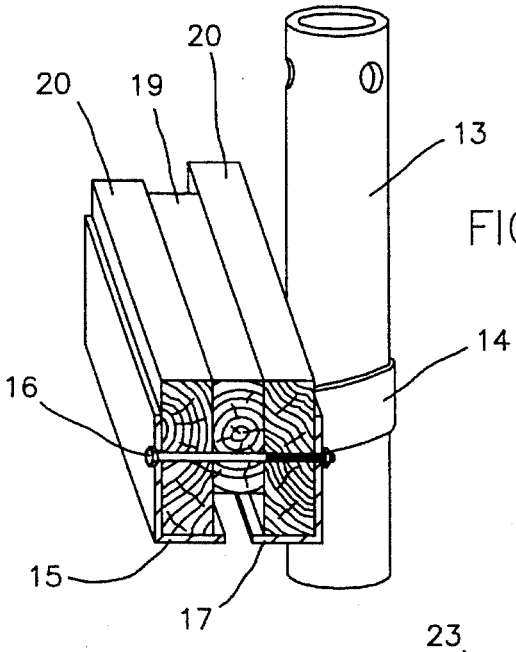
FIG. 2 is a perspective view of the present invention having two plates sandwiching the roof support beam; with the actual roof covering not shown.
Figure 1:
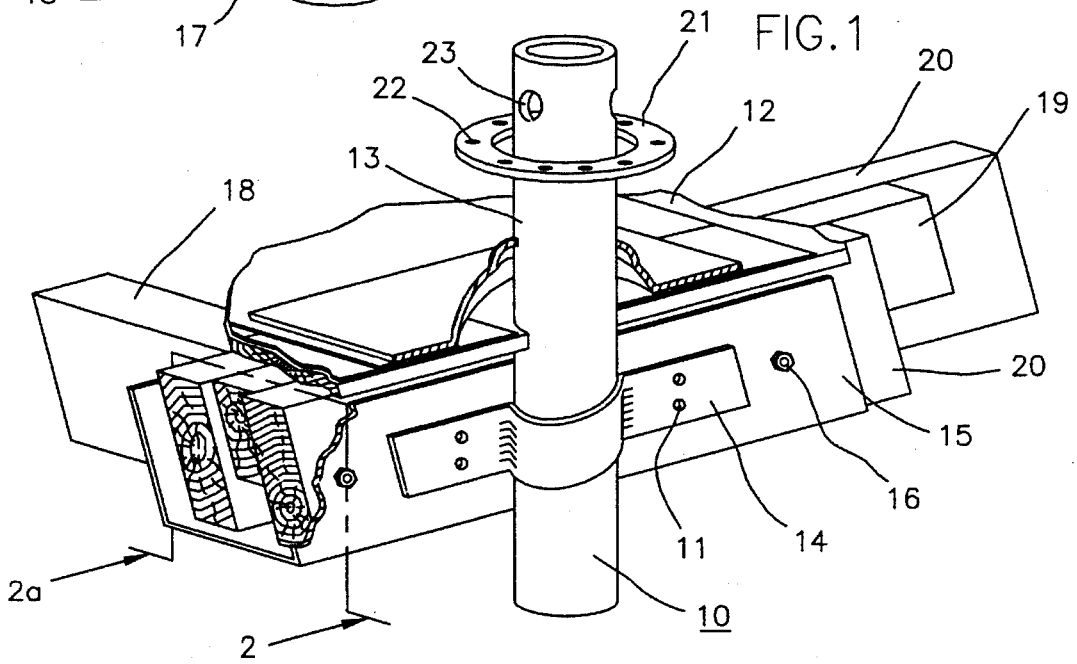
FIG. 1 is a perspective view of the present invention positioned on its mounting support; with the actual roof covering, not shown.

There is disclosed an apparatus 10, for mounting a combined roof plumbing vent, and a safety stanchion element 13, with duct closure 16, attachable thereto, and the assembly erectable on a roof through its roof covering, the elements having a mounting bracket, in conjunction with at least one roof beam. It is well known in the trades that plumbing "vents" are typically metal or plastic rigid pipes connected to the interior of the house plumbing, in order to allow the exhaust of foul air created by the plumbing system to be "vented" to the surrounding atmosphere, and which pipes without extra bracing and strengthening would not be safe to meet the OSHA regulation 1926.104 for (the 5,400 pound pull test) safety line attachment. A beam element 19, being formed by fixedly connecting with a least one roof beam element 19, a substantially vertical safety stanchion element 13, having a cap 16, is selectively attachable to make the unit weathertite when it is used as a stanchion only. The selective attachment can be by welding, male and female threading, or by adhesive fastening, all in a manner known in the art. The cap or plate can be flat or cup shaped and being a fixably attached in a known manner. The roof covering is not shown. At least one transverse roof support element 18, is employed to stiffen and to distribute the transverse loading from the use of the devise as a stanchion. This cross bracing is some-times known as bridging. The use of this device as a stanchion is predicated on safety of an operator working on a roof surface wherein the operator makes a removable connection to the stanchion at one end of a tether and the opposing end of the tether is attached to the operator for the personal safety of the operator while working on the roof. A tubular sleeve member or safety stanchion element 13, positioned through said roof covering, and formed connected to a "U" shaped, cross section, plate 15; or a sandwich of two plates 15, and 17, along with scabs or wooden plate reinforcing elements 20, forming a reinforcing means mounting bracket and said tubular sleeve vent element, having at least two openings (one vent entrance opening and one vent exit opening), there through and fasteners, attaching and sandwiching said plates 15, and 17, snugly and securely to at least one roof support roof beam element 19, and a tubular collar roof covering member affixed to the plate member (usually called "vent stack flashing" and which is now shown in the FIG. 1) in axial alignment with the roof opening thereby forming a safety stanchion element 13, for plumbing vent use and stanchion use. The safety stanchion element 13, is positioned in axial alignment with the bore in the roof, not shown, and roof covering also not shown and having at its upper end at least one opening 23 in the circumference thereof, for attaching the workman's tether. The mounting apparatus also comprises a mounting member 14, positioned and attached to the plate 17, which in turn is clamped or sandwiched against the roof beam element 19. There are several cross members or bridge members forming an attachment member for the tubular roof plumbing safety stanchion element 13, with its reinforcing strap member 14 fixedly attached to the attachment member. The duct formed in the tubular safety stanchion element 13, is fixably engaged with the formed mounting bracket. This vent element 13, fabricated to be mounted through the roof to provide a tie-off stanchion or mast, and to provide a convenient and secure support for workers safety while working on the roof, while at the same time serving as the plumbing vent, through the roof wherein the remainder of the household plumbing may be selectively attached to the lower end of the vent element to vent or exhaust the four air to the plumbing system. The attachment can be by bolts 11, or other suitable means, and a collar 21, with snap ring openings 22, can be provided to fit over the tubular sleeve stanchion-vent 13, element and through the roof, not shown, to form an anchor ring to secure a safety line to this stanchion-vent element 13.

What is claimed:

1. A combination hollow rigid tubular stanchion-element adapted to be mounted through an opening in a parallel beam supported roof or similar substantially flat plane building structural covering member, with said roof being formed by a plurality of parallel spaced roof beam supports, having at least one bore or opening through the roof comprising;

a tubular stanchion-element adapted to be positioned within the bore or opening through said beam supported roof and, a snug fitting roof collar covering means adapted to be snugly attached to both the roof and the stanchion-element, to cover said roof bore and the space there between, and, at least two perforated plates with nuts, bolts and washers said two plates adapted to be attached by bolts, nuts and washers passing through said perforations in said plates and at least one said roof support beam, and, to either side of, and tightening against and sandwiching at least one parallel beam roof support adjacent said roof bore, and, said perforated plates adapted to accept for permanent attachment of the stanchion element to at least one plate member and through and positioning said tubular stanchion element in axial alignment with the said at least one bore or opening, wherein said stanchion element and the perforated plate members form a unitary stanchion structure, adapted to sustain a tie off for a transverse load to secure support for workers safety while working on the roof, a snug fitting perforated ring collar means, said collar means adapted to be securely positioned around the stanchion element located adjacent to and free from attachment to said roof, said collar means to provide a plurality of attachment ports through the perforations to provide said tie off for said of transverse load to secure support for workers safety while working on the roof.

* * * * *